US008019272B2

(12) United States Patent
Masuda

(10) Patent No.: US 8,019,272 B2
(45) Date of Patent: Sep. 13, 2011

(54) CONTENT REPRODUCING APPARATUS AND COMMUNICATION METHOD THEREFOR

(75) Inventor: Masaya Masuda, Fussa (JP)

(73) Assignee: Kabushiki Kaisha Toshiba (JP)

( * ) Notice: Subject to any disclaimer, the term of this patent is extended or adjusted under 35 U.S.C. 154(b) by 747 days.

(21) Appl. No.: 12/050,084

(22) Filed: Mar. 17, 2008

(65) Prior Publication Data

US 2008/0268771 A1 Oct. 30, 2008

(30) Foreign Application Priority Data

Apr. 27, 2007 (JP) ..... 2007-119840

(51) Int. Cl.
*H04H 20/71* (2008.01)

(52) U.S. Cl. ..... 455/3.01; 455/41.2; 455/3.06

(58) Field of Classification Search ..... 455/3.01, 455/569.1, 3.06; 381/311, 309
See application file for complete search history.

(56) References Cited

U.S. PATENT DOCUMENTS

| | | | | |
|---|---|---|---|---|
| 2002/0098878 | A1* | 7/2002 | Mooney et al. | 455/569 |
| 2003/0223604 | A1* | 12/2003 | Nakagawa | 381/311 |
| 2006/0190577 | A1* | 8/2006 | Yamada | 709/223 |
| 2007/0043739 | A1* | 2/2007 | Takai et al. | 707/10 |

FOREIGN PATENT DOCUMENTS

| | | |
|---|---|---|
| JP | 2004-80738 | 3/2004 |
| JP | 2005-39432 | 2/2005 |
| JP | 2005-346800 | 12/2005 |

* cited by examiner

*Primary Examiner* — Edward Urban
*Assistant Examiner* — Golam Sorowar
(74) *Attorney, Agent, or Firm* — Knobbe Martens Olson & Bear LLP

(57) ABSTRACT

According to one embodiment, a content reproducing apparatus includes a wireless communication unit which performs wireless communication with a plurality of wireless communication apparatuses, a reproducing unit which reproduces streaming data received by the wireless communication unit depending on a predetermined reproducing order, and a control unit which starts a communication connection process between the wireless communication apparatus which stores streaming data to be reproduced next in the reproducing order and the wireless communication unit at a predetermined period of time before reproduction end prediction time of the streaming data which is being reproduced by the reproducing unit.

10 Claims, 8 Drawing Sheets

Playlist

| | Content name | Holding apparatus | Time | Total time |
|---|---|---|---|---|
| 1 | Rock concert a | Wireless communication apparatus MA | 24:17 | 24:37 |
| 2 | Rakugo b | Wireless communication apparatus MB | 12:15 | 12:35 |
| 3 | Travelogue c | Wireless communication apparatus MB | 9:01 | 9:01 |
| 4 | Drama d | Wireless communication apparatus MC | 48:51 | 49:01 |
| 5 | Entrance ceremony e | Main body MO | 15:35 | 15:35 |

Request list

Reserved by wireless communication apparatus MC

| In reproduction | Content name | Holding apparatus | Time | Total time |
|---|---|---|---|---|
| → | 1 Promotional video a | Wireless communication apparatus MA | 12:30 | 12:40 |
| | 2 News b | Wireless communication apparatus MB | 5:12 | 5:32 |
| | 3 Variety c | Wireless communication apparatus MC | 30:52 | 31:02 |

CONTENT REPRODUCING APPARATUS AND COMMUNICATION METHOD THEREFOR

CROSS-REFERENCE TO RELATED APPLICATIONS

This application is based upon and claims the benefit of priority from Japanese Patent Application No. 2007-119840, filed Apr. 27, 2007, the entire contents of which are incorporated herein by reference.

BACKGROUND

1. Field

One embodiment of the invention relates to a content reproducing apparatus which acquires content data such as audio data or video data by wireless communication to reproduce the content data and a communication method for the content reproducing apparatus.

2. Description of the Related Art

As is well known, in recent years, along with the popularization of a wireless communication technique and a digital processing technique, a system which transmits streaming data such as audio data and video data by wireless communication is increasingly demanded. For example, there is a system which performs communication with a plurality of wireless communication apparatuses by wireless communication such as Bluetooth (registered trademark) to acquire audio data by streaming and causes a user to hear the content with wireless headphones.

Jpn. Pat. Appln. KOKAI Publication No. 2005-39432 discloses a technique related to a reproducing apparatus with a communication function wherein packet reproducing time is calculated from an entire reproducing time of content data and a current reproducing elapsed time, the reproducing time and the entire reproducing time are compared with each other to measure an elapsed time, and, when the elapsed time runs out, streaming communication from a wireless communication apparatus is ended.

However, in the technique described in Jpn. Pat. Appln. KOKAI Publication No. 2005-39432, the streaming communication is ended depending predicted end time in streaming communication with one wireless communication apparatus. For this reason, when a plurality of content data items stored in a plurality of wireless communication apparatuses are to be sequentially acquired/reproduced, in particular, a long time is taken to start communication with a new wireless communication apparatus. As a result, a time in which reproduction of content data such as music is impossible may occur at a start of communication with a new wireless communication apparatus. This may interrupt continuous reproduction of the content data to generate a long silent interval, so that the convenience of a user may be spoiled.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a content reproducing apparatus includes a wireless communication unit which performs wireless communication with a plurality of wireless communication apparatuses, a reproducing unit which reproduces streaming data received by the wireless communication unit depending on a predetermined reproducing order, and a control unit which starts a communication connection process between the wireless communication apparatus which stores streaming data to be reproduced next in the reproducing order and the wireless communication unit a predetermined period of time before reproduction end prediction time of the streaming data which is being reproduced by the reproducing unit.

(Configuration)

Figure 1:
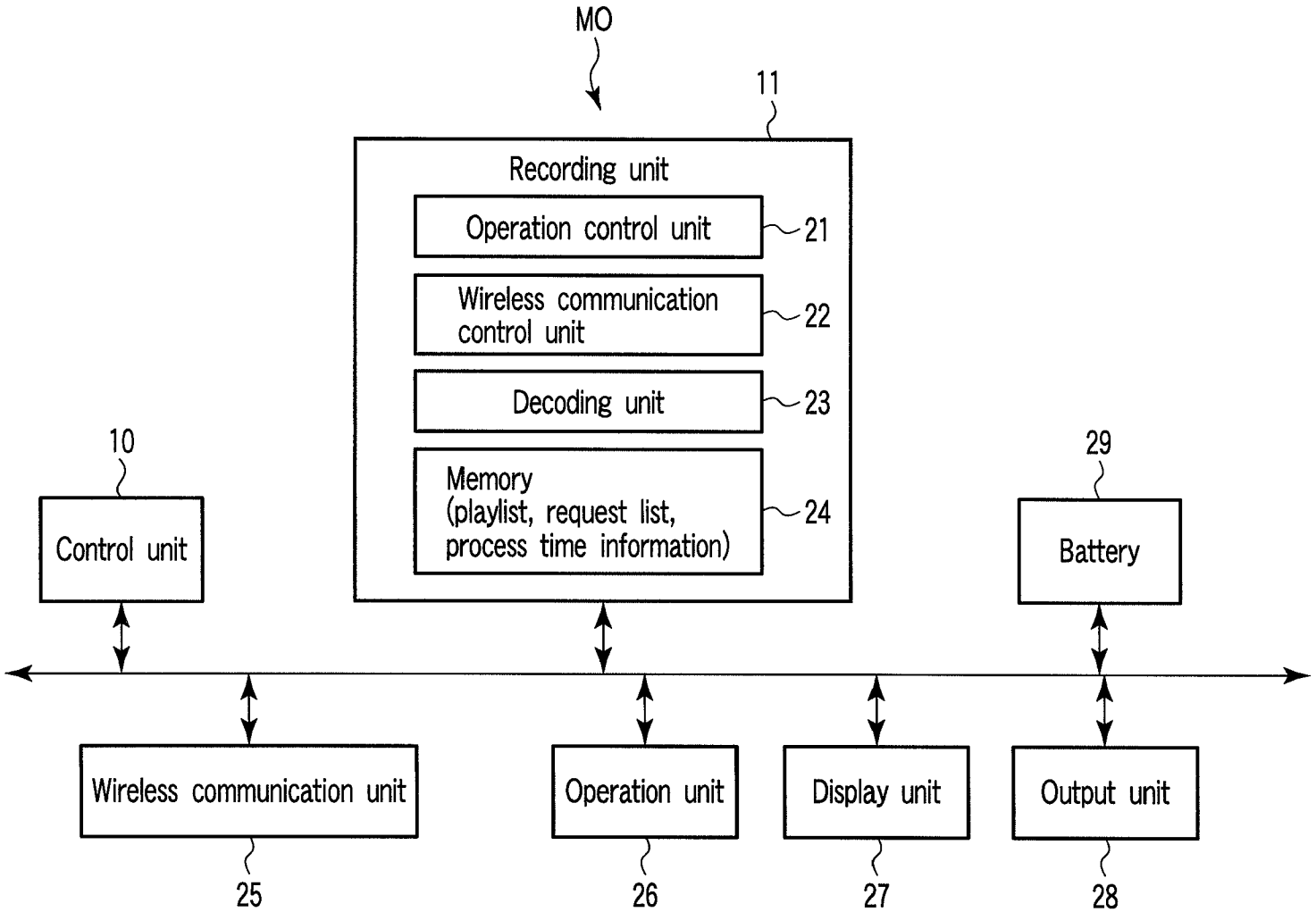
FIG. 1 shows an embodiment of the present invention, and is a block diagram shown to explain an example of a configuration of a content reproducing apparatus.
Figure 2:
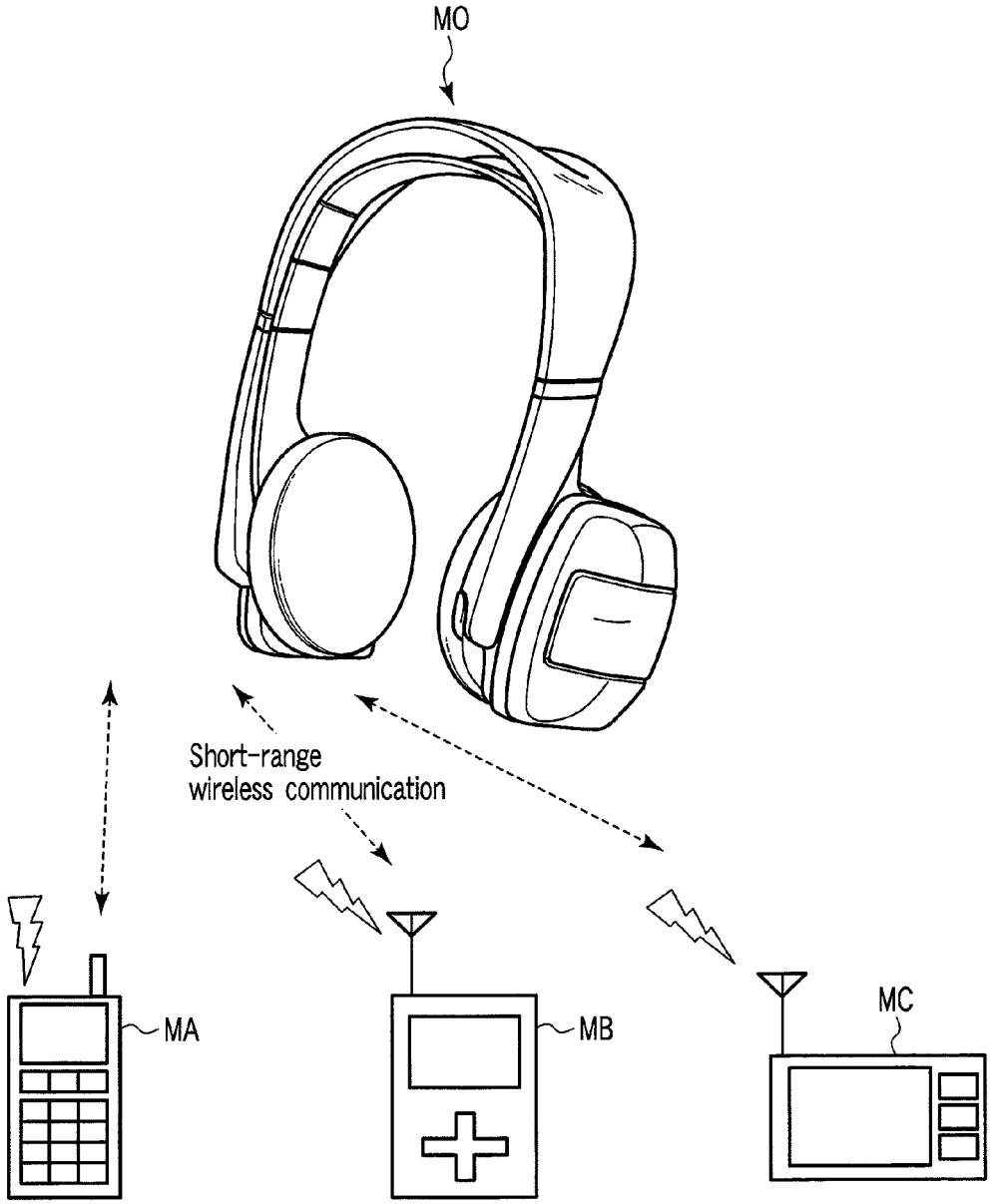
FIG. 2 is a diagram shown to explain an example of a communication mode between a content reproducing apparatus and a wireless communication apparatus in the embodiment.

A content reproducing apparatus MO to be described as an embodiment of the invention, as shown in FIG. 1, is a wireless communication apparatus used as a receiver for streaming data and preferably includes a transmission function. The content reproducing apparatus may be a playback device for playing audiovisual content, for example. As shown in FIG. 2, the content reproducing apparatus MO is a wireless communication apparatus which performs wireless communication with a wireless communication apparatus MA, a wireless communication apparatus MB, a wireless communication apparatus MC, and the like in which content data are stored.

In this case, as an example, the embodiment will be explained with a usage scene in which audio streaming data (may be moving image data) transmitted from audio players through a wireless communication is received by a wireless headphone. More specifically, in the configuration, the content reproducing apparatus MO is, for example, wireless headphones as shown in FIG. 2; the wireless communication apparatus MA is a mobile phone; the wireless communication apparatus MB is an audio player; and the wireless communication apparatus MC is a multimedia player with television function.

Figure 3:
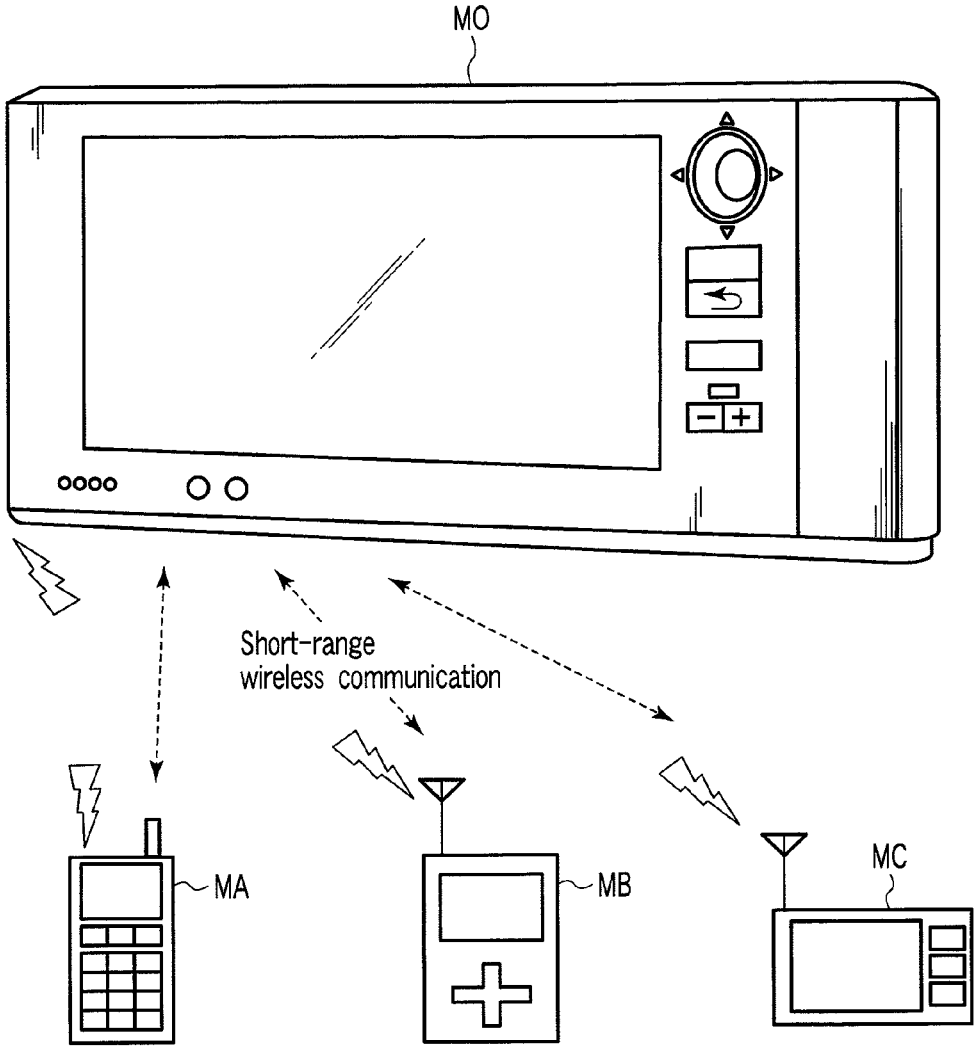
FIG. 3 is a diagram shown to explain another example of a communication mode between the content reproducing apparatus and the wireless communication apparatus in the embodiment.

Though the content reproducing apparatus MO is at least required to be configured as an apparatus having a receiving function for streaming data, the content reproducing apparatus MO is preferably a reproducing apparatus having a display function and a video reproducing function, as shown in FIG. 3. Similarly, the wireless communication apparatus MA, the wireless communication apparatus MB, the wireless communication apparatus MC is at least required to be configured as streaming data transmitting apparatuses. The streaming data to be transmitted or received is not limited to audio data. For example, as the streaming data, video data is preferably used.

The content reproducing apparatus MO, as shown in FIG. 1, has a control unit 10 which controls an entire operation, a recording unit 11 which records and reproduces content given as streaming data from an external device or the like, and a battery 29 which supplies a power for the operation. Furthermore, the content reproducing apparatus MO, as shown in FIG. 1, includes a wireless communication unit 25 which communicates with an external wireless communication apparatus by a wireless communication standard such as Bluetooth (registered trademark), an operation unit 26 which gives an operation signal to the control unit 10 or the like in response to an operation by a user, a display unit 27 such as a liquid crystal display which displays, for example, a playlist representing a reproducing order or the like of content (to be described later) and a moving image depending on the content, and an output unit 28 such as a loudspeaker or an interface which outputs output data.

The recording unit 11 includes an operation control unit 21 which controls an operation of the recording unit 11, a memory unit 24 which stores content data, a playlist (to be described later), a request list, and process time information such as a process time of each wireless communication apparatus, a decoding unit 23 which performs a decoding process to the content data stored in the memory unit 24 and content data given externally as streaming data, and a wireless communication control unit 22 which controls an operation of, especially, the wireless communication unit 25.

The content reproducing apparatus MO having the above configuration is a wireless communication apparatus having a function which causes the decoding unit 23 to decode streaming data mainly received through the wireless communication unit 25 under the control of the wireless communication control unit 22 and outputs the decoded data to the output unit 28 as reproducing data.

In this case, the wireless communication unit 25 controlled by the wireless communication control unit 22 can perform short-range wireless communication with the other wireless communication apparatuses MA, MB and MC, etc., and is, for example, a Bluetooth (registered trademark) communication apparatus. The decoding unit 23 has a decoding function using at least one encoding scheme.

The memory unit 24 stores reproducing content information, identification information of a wireless communication apparatus holding data of the content, and information (to be described later in detail) which associates information of a process time to the wireless communication apparatus.

When the content reproducing apparatus MO is designated by a user through the operation unit 26 to be wirelessly connected to the wireless communication apparatus MA, the wireless communication apparatus MB, and the wireless communication apparatus MC, or when wireless connection is automatically connected by the operation control unit 21, or, in contrast to this, when wireless connection is designated by the wireless communication apparatus MA, the wireless communication apparatus MB, or the wireless communication apparatus MC, a connection process is performed by the wireless communication unit 25 controlled by the wireless communication control unit 22.

The content reproducing apparatus MO, the wireless communication apparatus MA, the wireless communication apparatus MB, and the wireless communication apparatus MC are connected to each other by a method defined by, for example, a Bluetooth (registered trademark) audio/video remote control profile (AVRCP) or advanced audio distribution profile (A2DP) and set in a state in which interactive wireless communication of remote control data or audio data is made possible.

When a user selects content from the playlist displayed on the display unit 27 of the content reproducing apparatus MO to designate the operation unit 26 to perform audio streaming reproduction, or when the operation unit (not shown) of the wireless communication apparatus MA, the wireless communication apparatus MB, or the wireless communication apparatus MC is designated to perform audio streaming reproduction, the encoded streaming data is received by the content reproducing apparatus MO through the wireless communication unit 25, and the reproduced data decoded by the decoding unit 23 is output as sound from the output unit 28. In this manner, audio data can be reproduced among the content reproducing apparatus MO, the wireless communication apparatus MA, the wireless communication apparatus MB, and the wireless communication apparatus MC.

The content reproducing apparatus MO displays a playlist or the like on the display unit 27. At this time, when a user selects desired content from the playlist or when the user designates sequential reproduction on the basis of the playlist, the content reproducing apparatus MO is designed to be similarly wirelessly connected to the apparatus holding the data of the content to designate reproduction, thereby making it possible to reproduce the content held in the plurality of wireless communication apparatuses in a desired order.

<Communication Method for Content Reproducing Apparatus serving as Embodiment of the Invention>

A communication method for a content reproducing apparatus according to an embodiment of the invention will be described below in detail with reference to a flowchart.

(Outline)

In the content reproducing apparatus MO according to the embodiment of the invention, when streaming reproduction of content data stored in a plurality of wireless communication apparatuses is sequentially performed according to a playlist (FIG. 5) (to be described later) or a request list (FIG. 6) communication with the wireless communication apparatuses is started in consideration of process times of the wireless communication apparatuses to exclude a silent interval caused by an apparatus switching process. Thus, a comfortable continuous reproducing process can be performed through the wireless communication as if the content reproducing apparatus MO reproduces the plurality of contents that stored in its main body.

Figures 4, 5:
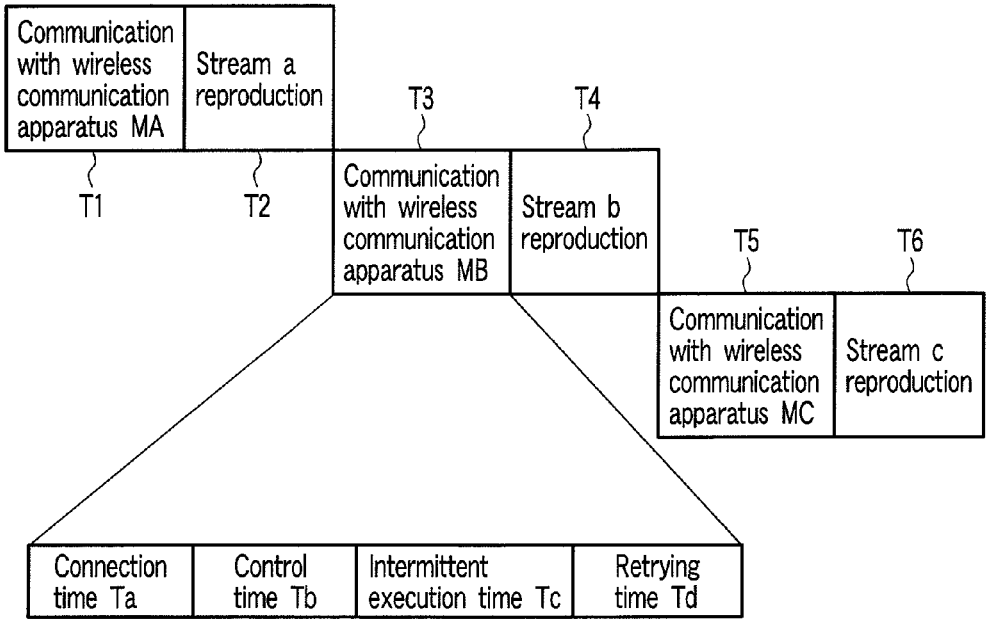
FIG. 4 is a diagram shown to explain an example of a communication process between the content reproducing apparatus and the wireless communication apparatus when the present invention is not applied.
FIG. 5 is a diagram shown to explain an example of a playlist which is handled by the content reproducing apparatus in the embodiment.

More specifically, as shown in a timing chart in FIG. 4, it is assumed that a stream a is reproduced from the first wireless communication apparatus MA, a stream b is reproduced from the second wireless communication apparatus MB, and a stream c is reproduced from the third wireless communication apparatus MC. When the wireless communication apparatuses are accessed after the reproduction of the streams is finished, silent intervals (intervals T3 and T5 in FIG. 4) between reproductions of the contents occur for times required for communication with the wireless communication apparatuses, so that reproduction which is uncomfortable for a user is performed.

At this time, process time information [apparatus to be connected] which means the process time (T3) for a wireless communication apparatus is given by the following equation: as shown in FIG. 4, process time information [apparatus to be connected]=time (Ta) required for connection process+time (Tb) required for control of its own apparatus+time (Tc) required for intermittent execution+time (Td) required for retrying.

In this case, the "time (Ta) required for connecting process" means a time taken until a connection procedure, which is performed until stream reproduction is finished that includes an authentication process between the content reproducing apparatus MO and the wireless communication apparatuses MA, MB, or MC, becomes possible.

The "time (Tb) required for control of its own apparatus" means time required for controlling the respective units of the content reproducing apparatus MO by the control unit 10.

The "time (Tc) required for intermittent execution" is obtained by accumulating margin times required for division when a process between the content reproducing apparatus MO and the wireless communication apparatuses MA, MB, or MC is divided into a plurality of processes not to disturb other processes.

For example, when the authentication process is not successful by performing the authentication process only once, retrying is performed a predetermined number of times. The "time (Td)" means a total sum of extension times when the retrying is performed all the predetermined period of times.

The process time information [apparatus to be connected] which is a total sum of these times is preferably measured in association with the types of the target wireless communication apparatuses MA, MB, or MC, etc. and stored in the memory unit 24 as table information. The process time information is preferably displayed in addition to a playlist shown in FIG. 5 or the request list shown in FIG. 6. However, even though the process time information is not always displayed in addition to the playlist or the request list, elimination of a silent interval which is the operation effect of the embodiment of the invention can be achieved.

More specifically, the playlist shown in FIG. 5 is stored in the memory unit 24 or the like, and can be formed by a user. The playlist shown in FIG. 5 includes a reproducing time of content and the above process time information [apparatus to be connected] together with identification information of the content and identification information of the wireless communication apparatus holding the data of the content.

The reproducing time of the content need not be always held in advance because the reproducing time is designed to be able to be acquired at a start of the reproduction according to the embodiment (to be described later). In FIG. 5, the total time of the reproducing time of the content and the process time information [apparatus to be connected] is displayed. However, the reproducing time of the content and the total time need not be always displayed.

Figures 6, 11:
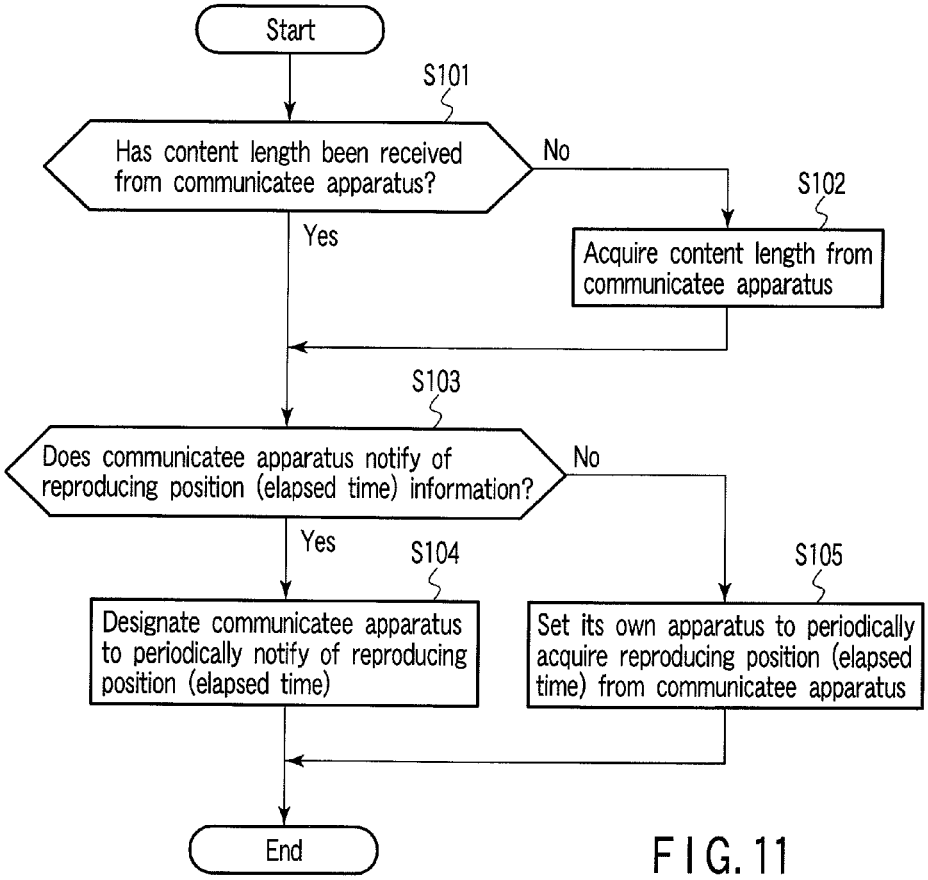
FIG. 6 is a diagram shown to explain an example of a request list handled by the content reproducing apparatus in the embodiment.
FIG. 11 is a flowchart shown to explain the details of a part of the communication process operation of the content reproducing apparatus in the embodiment.

Similarly, in the request list shown in FIG. 6, for example, even though content is being reproduced, the content to be reproduced can be requested to be added by an operation by a wireless communication apparatus of a communicatee. This request list includes the identification information of content and the identification information of the wireless communication apparatus holding the data of the content, the reproducing time of the content, and the above-described process time information [apparatus to be connected].

Since the reproducing time of the content is designed to be able to be acquired at the start of reproduction in the embodiment, the reproducing time need not be always held in advance. Although FIG. 6 displays a total time of the reproducing time of the content and the process time information [apparatus to be connected]. However, the reproducing time of the content and the total time need not be always displayed.

In the description of the embodiment, a time inherent in each target apparatus is set as the process time information for an apparatus. However, the process time information for the apparatus may be determined and held in an arbitrary shape. As a matter of course, the same time may be set to all the apparatuses. Although the time to be held is a total sum of a plurality of times, a fixed time may be set.

Furthermore, the wireless communication control unit 22 of the recording unit 11 is designed to notify the wireless communication apparatuses MA, MB, or MC of a communicatee of information of a length (to be simply referred to as a content length hereinafter) of streaming content which is being reproduced by the content reproducing apparatus MO and a current reproducing position (elapsed time) through the wireless communication unit 25, or to be able to acquire the information from the communicatee apparatus.

In this case, in order to perform notification or acquisition of the information of the content length or the reproducing position, for example, a VENDOR DEPENDENT command defined in the Bluetooth (registered trademark) AVRCP specification is preferably used. More specifically, a content length is acquired by GetPlayStatus of a VENDOR DEPENDENT command of the AVRCP after the reproduction is started. Thereafter, setting is performed such that a communicatee apparatus is notified of a change of a reproduction position (EVENT_PLAYBACK_POS_CHANGED) by RegisterNotification. Alternatively, when the communicatee side cannot be notified the change, setting may be performed to periodically acquire the reproduction position by GetPlayStatus from this side. The details will be described in an explanation of a flowchart (to be described later). As a matter of course, a command may be defined by another method other than the AVRCP method, for example, a serial port profile (SPP).

In this manner, the wireless communication control unit 22 of the control unit 10 or the recording unit 11 acquires the information of the content length to make it possible to know a time until the current streaming content is ended by the following equation:

$$\text{(time until end of content)}=\text{(content length)}-\text{(current reproducing position)}.$$

The above function is given to the wireless communication control unit 22 of the recording unit 11 to make it possible to know information on the process time for the next content holding wireless communication apparatus and the time until the end of the current content. The wireless communication control unit 22, on the basis of the pieces of time information collected as described above, controls the wireless communication unit 25 such that a connecting process to the next content holding apparatus is started at the time that predate the end of the current content by the process time.

(Explanation of Communication Method by Flowchart)

A wireless communication control method according to an embodiment of the invention will be described below with reference to a flowchart shown in FIG. 9. In a concrete process explanation in the following description, an example given when the Bluetooth (registered trademark) AVRCP is used will be described.

The control unit 10 and the wireless communication control unit 22 load the playlist (FIG. 5) or the request list (FIG. 6) from the memory unit 24 and load the process time information for the wireless communication apparatus (step S11). The control unit 10 and the wireless communication control unit 22 check whether the control unit 10 and the wireless communication control unit 22 are designated to perform a reproducing process according to the playlist (FIG. 5) or the request list (FIG. 6) from the operation unit 26 by a user (step S12).

Upon detecting a reproducing designation (step S12), the control unit 10 and the wireless communication control unit 22 shift to step S13 to wait until the control unit 10 and the wireless communication control unit 22 are designated to reproduce content.

Upon detecting the reproduction designation, the control unit 10 and the wireless communication control unit 22 specify the wireless communication apparatus holding content data designated to be reproduced from the playlist (FIG. 5), the request list (FIG. 6), or the like and perform a connection process to the communicatee apparatus (step S13).

Upon completion of the connection to the communicatee wireless communication apparatus, the control unit 10 and the wireless communication control unit 22 designate the communicatee apparatus to reproduce the content (step S14). In this manner, the control unit 10 and the wireless communication control unit 22 receive streaming data from the wireless communication apparatus of the communicatee through the wireless communication unit 25, and the decoding unit 23 decodes and reproduces the streaming data to output a video signal to the display unit 27 or output audio data to the output unit 28.

At the start of reproduction in this case, as shown in a flowchart in FIG. 11, a "content length" and a "reproducing position (elapsed time)" are acquired from the wireless communication apparatus of the communicatee and served in the reproducing process.

More specifically, as shown in the flowchart in FIG. 11, the control unit 10 and the wireless communication control unit 22 execute a setting process at the start of reproduction when the reproduction of the content is started. The control unit 10 and the wireless communication control unit 22 check whether the control unit 10 and the wireless communication control unit 22 have received the content length from the communicatee apparatus (step S101).

When the content length has not been received, the control unit 10 and the wireless communication control unit 22 acquire "content length" information from the wireless communication apparatus of the communicatee through the wireless communication unit 25 (step S102). This process serves as, in particular, a process of acquiring the content length by transmitting the GetPlayStatus of the VENDOR DEPENDENT command.

When the "content length" information has been received, the control unit 10 and the wireless communication control unit 22 determine whether the wireless communication apparatus notifies of reproducing position (elapsed time) information of the content from the wireless communication apparatus of the communicatee through the wireless communication unit 25 (step S103). More specifically, the determination can be performed by checking whether EVENT_PLAYBACK_POS_CHANGED is included in response against GetCapabilities of the VENDOR DEPENDENT command that specifies EVENTS_SUPPORTED as its parameter.

As a result, when the communicatee apparatus can notify of the reproducing position (elapsed time) information (step S103), the control unit 10 and the wireless communication control unit 22 designate the communicatee apparatus to periodically notify of the reproducing position (step S104). The notification designation of the reproducing position, in particular, can be periodically performed by transmitting RegisterNotification of the VENDOR DEPENDENT command that specifies EVENT_PLAYBACK_POS_CHANGED as its parameter.

On the other hand, when the communicatee apparatus cannot notify of the reproducing position (elapsed time) information (step S103), the control unit 10 and the wireless communication control unit 22 set its own apparatus such that the content reproducing apparatus MO periodically acquires a reproducing position for the communicatee apparatus (step S105). In this case, in order to acquire the reproducing position by the content reproducing apparatus MO itself, in particular, the reproducing position can be acquired by transmitting the GetPlayStatus of the VENDOR DEPENDENT command. This is the end of the explanation of the setting process at the start of reproduction in the flowchart in FIG. 11, and the explanation subsequent to the flowchart in FIG. 9 is started again.

Figure 9:
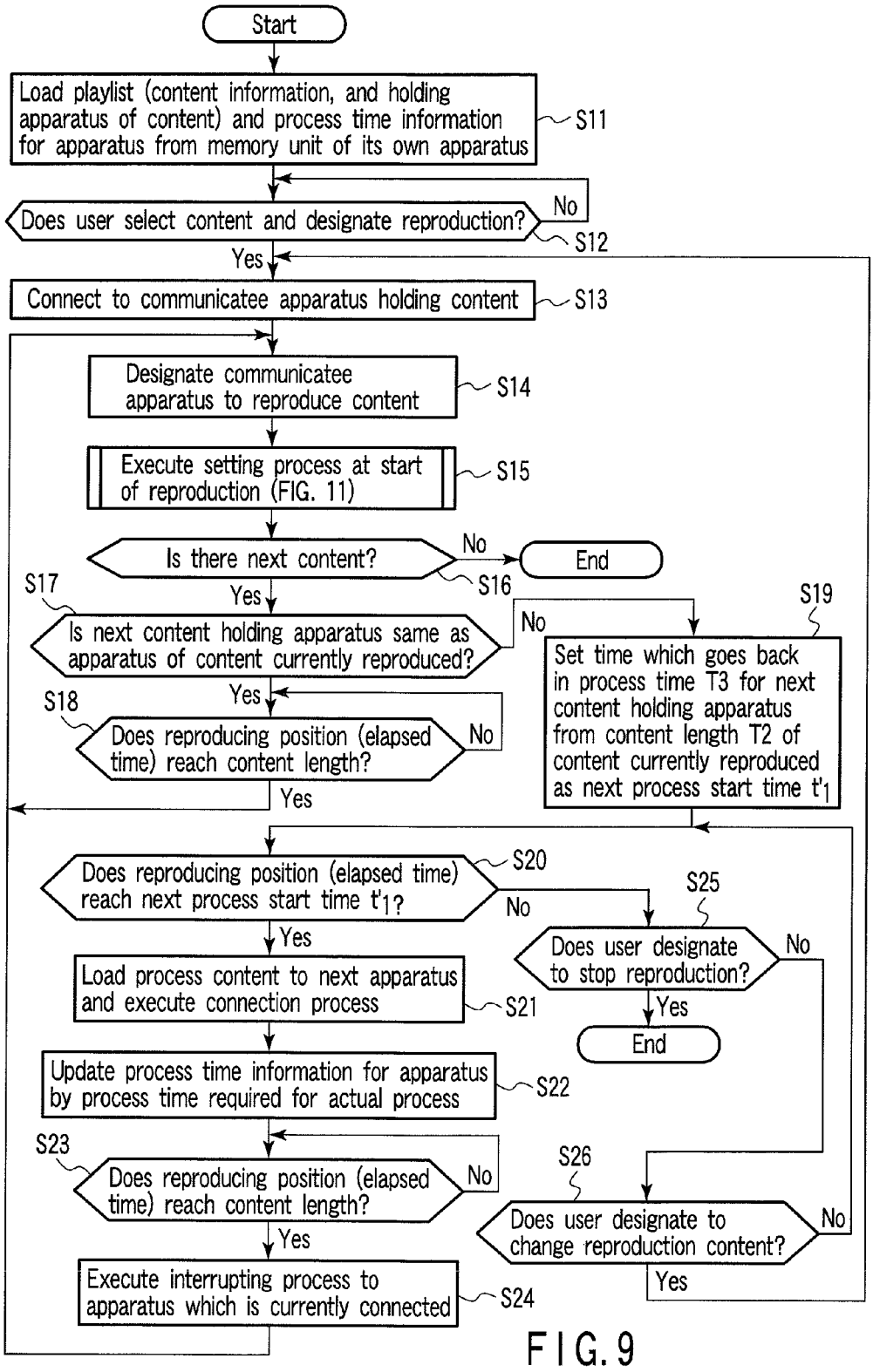
FIG. 9 is a flowchart shown to explain an example of a communication process operation of the content reproducing apparatus in the embodiment.

In the flowchart in FIG. 9, the control unit 10 and the wireless communication control unit 22 of the content reproducing apparatus MO determine whether there is content to be reproduced next to the content which is being currently reproduced by use of the playlist in FIG. 5 and/or the request list in FIG. 6. The control unit 10 and the wireless communication control unit 22 determine that there is the next content (step S16). When there is the next content, the process shifts to step S17, otherwise the process is ended.

When the control unit 10 and the wireless communication control unit 22 further reproduce the next content (step S16), the control unit 10 and the wireless communication control unit 22 specify an apparatus holding the data of the next content from, for example, the playlist in FIG. 5 and/or the request list in FIG. 6 to determine whether the apparatus is the same wireless communication apparatus as the communication apparatus holding the data of the content which is being currently reproduced (i.e., currently connected apparatus) or not (step S17).

When the control unit 10 and the wireless communication control unit 22 determine that the wireless communication apparatus holding the data of the next content is not the same as the current wireless communication apparatus (step S17), the process shifts to step S19. When the control unit 10 and the wireless communication control unit 22 determine that the wireless communication apparatus is the same as the current wireless communication apparatus, the process shifts to step S18 to wait for the end of reproduction of the current content (step S18). When the reproduction is ended, the process returns to step S14.

Figure 7:
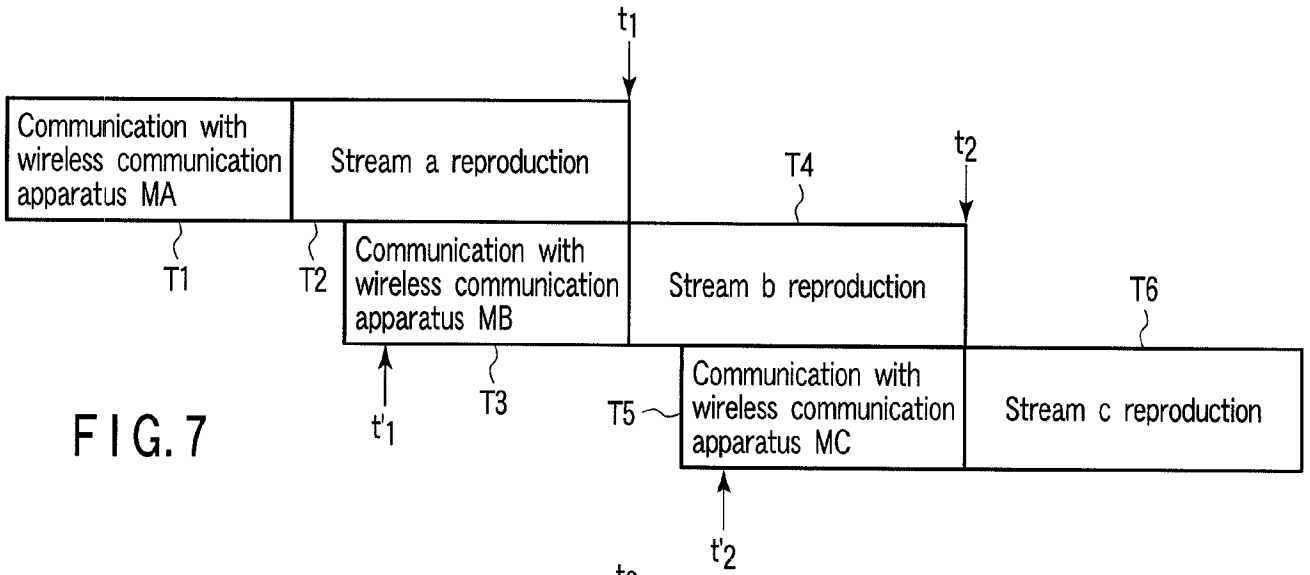
FIG. 7 is a diagram shown to explain an example of a processing process between the content reproducing apparatus and the wireless communication apparatus in the embodiment.
Figure 8:
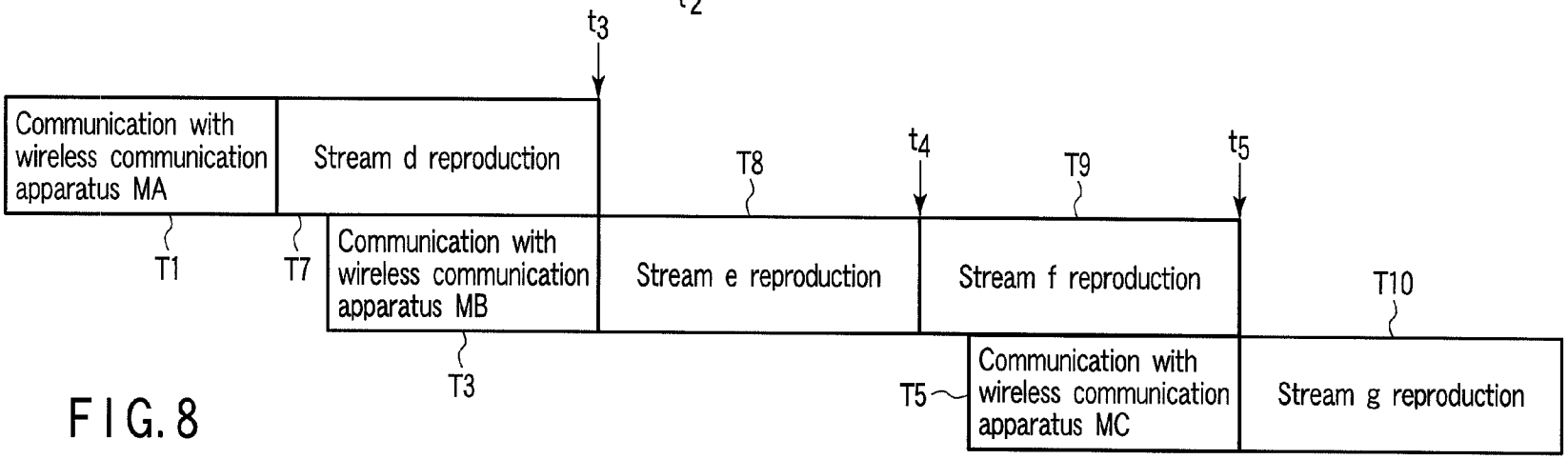
FIG. 8 is a diagram shown to explain another example of the communication process between the content reproducing apparatus and the wireless communication apparatus in the embodiment.

More specifically, FIG. 7 shows a timing chart when the wireless communication apparatus holding the next content data is different from the wireless communication apparatus holding the previous content data. FIG. 8 shows a timing chart when the wireless communication apparatus holding the next content data is the same as the wireless communication apparatus holding the previous content.

That is, as shown in FIG. 8, when the wireless communication apparatus holding the next content data and the wireless communication apparatus holding the previous content data are not changed, a process time required to start communication of the wireless communication apparatus need not be considered with respect to reproduction of a stream e to reproduction of a stream f. In this manner, start time (FIG. 8, t4) of streaming reproduction of the second and subsequent content items, i.e., acquisition start time of a stream can be determined.

On the other hand, in step S19, the wireless communication apparatus holding the next content data is different from the wireless communication apparatus holding the previous content data. FIG. 7 shows a timing chart obtained at this time. More specifically, since a destination is changed from the wireless communication apparatus MA to the wireless communication apparatus MB with respect to the reproduction of the stream a to the reproduction of stream b, start time (t1) of streaming reproduction of the next content must be determined in consideration of a process time (T3) required for the start of communication of the wireless communication apparatus MB.

More specifically, the control unit 10 and the wireless communication control unit 22 calculate second time (t1') which goes back in the process time (T3) of the wireless communication apparatus holding data of content to be reproduced next from first time (t1) at which the content currently reproduced is predicted to be ended on the basis of list information (FIG. 5 and/or FIG. 6) representing a reproducing order of a plurality of content items and identification information of the wireless communication apparatus holding the content, a reproducing time (T2) of the plurality of content items, and a process time (T3) required to start communication of the wireless communication apparatus. Control is performed to start communication by the wireless communication unit 22 with the wireless communication apparatus holding the content data to be reproduced next at this time (step S19).

In this manner, after the control unit 10 and the wireless communication control unit 22 determine the next process start time t1', a reproducing position (elapsed time Tx) is compared with the next process start time t1' to determine whether the reproducing position (elapsed time) reaches t1' (step S20). As a result, when the reproducing position (elapsed time) reaches t1', the control unit 10 and the wireless communication control unit 22 execute connect to the next wireless communication apparatus (step S21). Upon completion of the connection process, the process time information of the wireless communication apparatus is updated by a time actually required for the connection process (step S22). In this manner, the latest process time information for the wireless communication apparatus can be always held.

Furthermore, the reproducing process is continued until the reproducing position reaches the content length of the content (step S23). Thereafter, the reproducing process of the content is finished, the connection to the wireless communication apparatus is interrupted (disconnection or shift to a power-saving mode while maintaining connection) (step S24).

On the other hand, in step S20, when the stop of reproduction is designated by a user before the reproducing position reaches the start time t1' (step S25), the process is interrupted here. When the reproduced content is designated by a user to be changed (step S26), and the processes from step S13 are repeated according to the designation.

As described above, the content reproducing apparatus MO according to the embodiment starts communication with the next wireless communication apparatus depending on the process time information of the wireless communication apparatus holding the data of the next content in preparation for the next content as shown in the timing charts in FIGS. 7 and 8. In this manner, a silent interval does not occur between the reproduction of the content currently reproduced and the reproduction of the next content. For this reason, the content from the plurality of wireless communication apparatuses can be sequentially reproduced without giving unnaturalness to a user.

More specifically, according to the embodiment described above, information of the content length of streaming data which is being reproduced and a current reproducing position (elapsed time) is acquired, and a process time for a necessary start of communication is held. According to a combination of the information and the process time, communication to the next wireless communication apparatus is switched at an appropriate timing that goes back from streaming end prediction time in consideration of a time required for the process. In this manner, since switching of streaming apparatuses can be realized for a period of time shorter than that of a conventional technique, content can be smoothly and continuously reproduced without causing a silent interval to occur when the apparatuses are switched.

Figure 10:
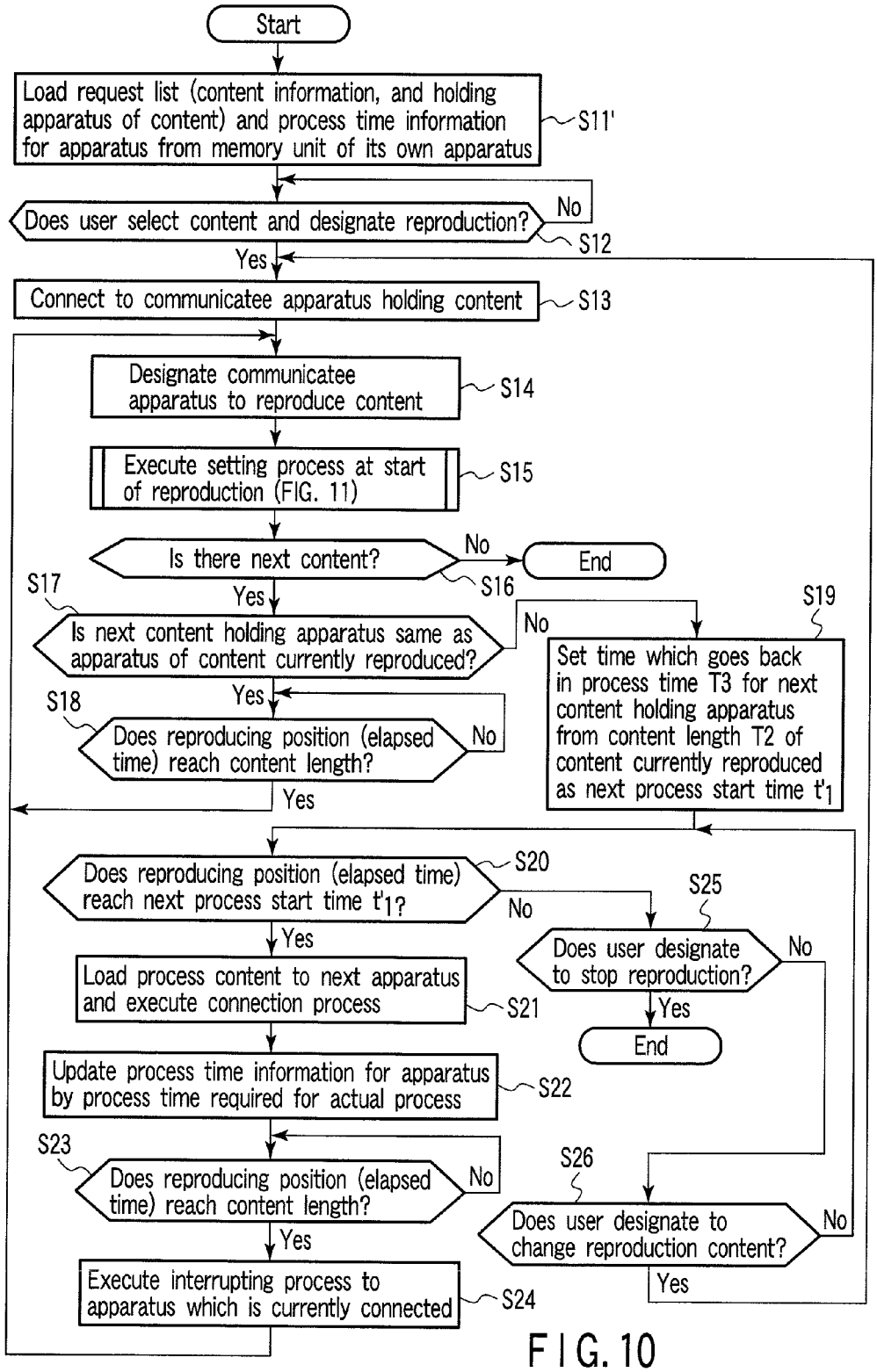
FIG. 10 is a flowchart shown to explain another example of the communication process operation of the content reproducing apparatus in the embodiment.

The flowchart in FIG. 10 shows the same reproducing process by using the request list shown in FIG. 6. More specifically, the process shown in the flowchart in FIG. 10 is almost the same as the process shown in the flowchart in FIG. 9, and explanation of the common steps will be omitted. The processes shown in the flowchart in FIG. 10 are different from those in the flowchart in FIG. 9 in only that reference information is the request list shown in FIG. 6 in step S11'.

The request list shown in FIG. 6 is managed by the control unit 10, the wireless communication control unit 22, and the like and updated in real time depending on a designation from the communicable wireless communication apparatuses MA, MB, or MC, etc. Therefore, unlike a playlist generated by a user or the like as shown in FIG. 5, reproducing and changing of arbitrary content can be designated depending on an operation of a user through the plurality of communicable wireless communication apparatuses MA, MB, or MC.

In another embodiment, the processes according to the above embodiment are preferably executed in a power-saving mode of a reproducing apparatus.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A content reproducing apparatus comprising:

a wireless communication unit configured to selectively perform wireless communication with a first plurality of wireless communication apparatuses, where each of the plurality of wireless communication apparatuses is capable of transmitting streaming data, the wireless communication unit configured to receive the streaming data;

a reproducing unit configured to reproduce the received streaming data by causing the wireless communication unit to communicate wirelessly with a second plurality of wireless communication apparatuses; and a control unit configured to:

control the wireless communication unit to receive the streaming data from the first plurality of wireless communication apparatuses;

control the reproducing unit to reproduce the streaming data by causing the wireless communication unit to perform wireless communication with the second plurality of wireless communication apparatuses based on a predetermined reproducing order; and start a communication connection process, as established in the predetermined reproducing order, between the wireless communication unit and one of the plurality of wireless communication apparatuses that transmits the streaming data to be received next by the wireless communication unit, the communication process started a predetermined period of time before the predicted reproduction end time of streaming data being reproduced by the reproducing unit so that the reproducing unit substantially sequentially reproduces the streaming data received from the plurality of wireless communication apparatuses.

2. A content reproducing apparatus according to claim 1, wherein the predetermined period of time is set not to be shorter than the sum of the time required for establishing a communication connection to the wireless communication apparatus that stores the streaming data to be received next and the time required for controlling the content reproducing apparatus to initiate said communication connection.

3. A content reproducing apparatus according to claim 1, wherein the predetermined time is set not to be shorter than the sum of the time required for establishing a communication connection to the wireless communication apparatus that stores the streaming data to be received next, the time required for controlling the content reproducing apparatus to initiate said communication connection, an intermittent execution time required for intermittent execution, and the time required for retrying to establish said communication connection in the event that it fails a first time.

4. A content reproducing apparatus according to claim 1, wherein the control unit is configured to acquire, from the wireless communication apparatus that stores the streaming data being reproduced at a present time, a reproducing time representing an entire time required for reproducing the streaming data which is being reproduced at the present, and an elapsed time from the start of reproduction of the streaming data currently being reproduced to the present time.

5. A content reproducing apparatus according to claim 1, wherein based on the reproducing order, while the streaming data is reproduced, a request signal is received from the wireless communication apparatus through the wireless communication unit to make it possible to add and modify the content of the reproducing order.

6. A content reproducing apparatus according to claim 1, wherein the control unit is configured to, when the streaming data to be received next is stored by the same wireless communication apparatus as streaming data being received at a present time, determine reproducing start time of the streaming data to be received next without considering the predetermined time.

7. A content reproducing apparatus according to claim 1, wherein the predetermined time is a fixed time.

8. A content reproducing apparatus according to claim 1, wherein the control unit is configured to update the predetermined time of the wireless communication apparatus on the basis of a time taken to establish a connection process with one of the plurality of wireless communication apparatuses in the past.

9. A content reproducing apparatus according to claim 1, further comprising a display unit configured to display an image depending on the streaming data reproduced by the reproducing unit on a screen.

10. A communication method for a content reproducing apparatus which performs streaming reproduction of streaming data by performing wireless communication with a first plurality of wireless communication apparatuses, comprising:

establishing wireless connections to the first plurality of wireless communication apparatuses, where the wireless communication apparatuses are each capable of transmitting streaming data, the wireless communication unit configured to receive the streaming data;

reproducing streaming data by causing the wireless communication unit to perform wireless communication with a second plurality of wireless communication apparatuses; and starting a communication connection process with the one of the second plurality of wireless communication apparatuses that transmits streaming data, as established in the predetermined reproducing order, at a predetermined time, the predetermined time occurring before the predicted reproducing end time of the streaming data being reproduced, the streaming data received from the plurality of wireless communication apparatuses thereby being sequentially reproduced.

* * * * *